US006997818B2

(12) United States Patent
Kouno

(10) Patent No.: US 6,997,818 B2
(45) Date of Patent: Feb. 14, 2006

(54) GOLF CLUBHEAD AND METHOD OF MANUFACTURING THE SAME

(75) Inventor: Masaru Kouno, Kobe (JP)

(73) Assignee: Sumitomo Rubber Industries, Ltd., Hyogo-ken (JP)

( * ) Notice: Subject to any disclaimer, the term of this patent is extended or adjusted under 35 U.S.C. 154(b) by 0 days.

(21) Appl. No.: 10/899,174

(22) Filed: Jul. 27, 2004

(65) Prior Publication Data

US 2004/0266552 A1 Dec. 30, 2004

Related U.S. Application Data

(62) Division of application No. 10/222,920, filed on Aug. 19, 2002, now Pat. No. 6,789,304.

(30) Foreign Application Priority Data

Aug. 30, 2001 (JP) ..... 2001-261989

(51) Int. Cl.
*A63B 53/02* (2006.01)
*A63B 53/04* (2006.01)

(52) U.S. Cl. ..... 473/305; 473/309; 473/345

(58) Field of Classification Search ..... 473/345–350, 473/305–315
See application file for complete search history.

(56) References Cited

U.S. PATENT DOCUMENTS 4,326,326 A 4/1982 MacDonald
4,417,731 A * 11/1983 Yamada ..... 473/309
4,438,931 A * 3/1984 Motomiya ..... 473/346
5,416,968 A 5/1995 Okumoto et al.
5,439,218 A * 8/1995 Gondeck ..... 473/308
5,575,723 A 11/1996 Take et al.
5,651,409 A 7/1997 Sheehan
5,709,614 A * 1/1998 Horiba ..... 473/305
5,755,627 A 5/1998 Yamazaki et al.
5,769,735 A 6/1998 Hosokawa (Continued)

FOREIGN PATENT DOCUMENTS

JP 61-51863 U 4/1986

(Continued)

*Primary Examiner*—Sebastiano Passaniti

(74) *Attorney, Agent, or Firm*—Birch, Stewart, Kolasch & Birch, LLP

(57) ABSTRACT

A golf clubhead containing a main body and a face member, the main body including a main shell portion having a hollow and a tubular inner extension of a hosel protruding in the hollow, and at least a part of the tubular inner extension separating from the inner surface of the main shell portion. A method of making the golf clubhead, which includes making a first lost form corresponding to the main shell portion, making a second lost form corresponding to the tubular inner extension, fixing the second lost form to the first lost form to make a third lost form corresponding to the main body, making a casting mold using the third lost form, and casting a metallic material into the main body using the casting mold.

8 Claims, 8 Drawing Sheets

U.S. PATENT DOCUMENTS 5,855,526 A * 1/1999 Honma ..... 473/310
5,888,148 A 3/1999 Allen
5,888,149 A * 3/1999 Allen ..... 473/309
5,931,742 A * 8/1999 Nishimura et al. ..... 473/305
5,938,541 A 8/1999 Allen et al.
5,961,394 A * 10/1999 Minabe ..... 473/305
6,033,318 A * 3/2000 Drajan et al. ..... 473/309
6,287,214 B1 * 9/2001 Satoh ..... 473/305
6,406,654 B1 6/2002 Perez et al.
6,450,896 B1 * 9/2002 Chen ..... 473/324
6,478,691 B1 * 11/2002 Okoshi ..... 473/324
6,514,153 B1 * 2/2003 Miyamoto et al. ..... 473/305

FOREIGN PATENT DOCUMENTS

JP 2-88677 U 7/1990

* cited by examiner

GOLF CLUBHEAD AND METHOD OF MANUFACTURING THE SAME

CROSS REFERENCE TO RELATED APPLICATIONS

This application is a Divisional of application Ser. No. 10/222,920, filed on Aug. 19, 2002 now U.S. Pat. No. 6,789,304, and for which priority is claimed under 35 U.S.C. § 120; and this application claims priority of Application No. 2001-261989 filed in Japan on Aug. 30, 2001 under 35 U.S.C. § 119; the entire contents of all are hereby incorporated by reference.

BACKGROUND OF THE INVENTION

The present invention relates to a golf clubhead and a manufacturing method therefor, and more particularly to an internal structure of the hosel portion of the golf club head which is capable of providing greater flexibility in the designing of the golf clubhead.

In recent years, there is a tendency for the wood-type golf clubs to increase the size or volume of the clubhead. Although the volume of the clubhead is increased, the weight of the clubhead should not be increased. In designing such a wood-type golf clubhead, a target weight and target volume of the clubhead are usually first given, and the position of the center of gravity of the clubhead, which greatly affects the position of the sweet spot, moment of inertia, performance, feel and the like, must be determined relative to the club shaft. In a conventional wood-type metal head whose volume is not so large, an extension of the hosel which is usually provided in the clubhead is formed as a protuberance extending along the inside of the clubhead as shown in FIGS. 13*a* and 13*b*. In this structure, if the head volume is increased and as a result it becomes necessary to shift the hosel portion towards the center of the clubhead, the protuberance becomes large and the weight is increased in this part. As a result, it becomes very difficult to adjust every design parameter to the desired target value. To satisfy one parameter, it becomes necessary to sacrifice another parameter. For example, the head volume is decreased to achieve the position of the center of gravity. Thus, it becomes very difficult to freely design such a clubhead.

SUMMARY OF THE INVENTION

It is therefore, an object of the present invention to provide a golf clubhead and a method of manufacturing the same, which can provide greater flexibility in designing the golf clubhead, and thus provide a clubhead of high-performance.

According to one aspect of the present invention, a golf clubhead comprises a main body and a face member, the main body comprising a main shell portion having a hollow and a tubular inner extension of a hosel protruding in the hollow, and at least a part of the tubular inner extension separating from the inner surface of the main shell portion. A method of making the golf clubhead comprises making a first lost form corresponding to the main shell portion, making a second lost form corresponding to the tubular inner extension, fixing the second lost form to the first lost form to make a third lost form corresponding to the main body, making a casting mold using the third lost form, and casting a metallic material into the main body using the casting mold.

Therefore, weight can be saved in the hosel part. As a result, greater flexibility in designing the clubhead can be obtained. For example, it becomes possible to shift the position of the center of gravity towards the toe. Further, the saved weight can be utilized for: lowering the position of the center of gravity; increasing the volume of the clubhead; increasing the moment of inertia of the clubhead; increasing the strength or durability by distributing to a weak part; and the like.

BRIEF DESCRIPTION OF THE DRAWINGS

The present invention will become more fully understood from the detailed description given hereinbelow and the accompanying drawings, which are given by way of illustration only, and thus are not limitative of the present invention, and wherein.

DESCRIPTION OF THE PREFERRED EMBODIMENTS

Figure 1:
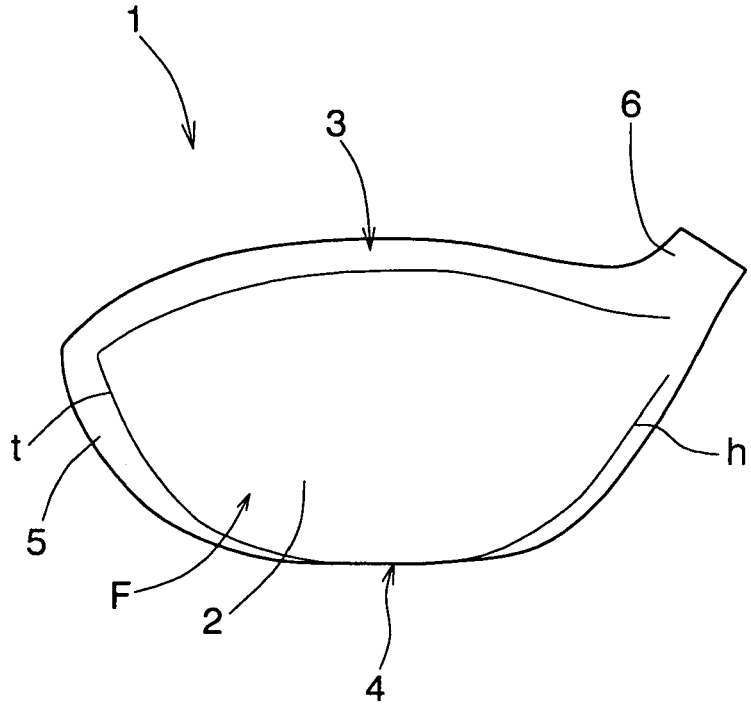
FIG. 1 is a front view of a wood-type golf clubhead according to the present invention.

Embodiments of the present invention will now be described in detail in conjunction with the accompanying drawings.

In the drawings, golf clubhead 1 according to the present invention is a wood type metal head.

The clubhead 1 comprises: a face portion 2 whose outer surface defines a clubface F for striking a golf ball; a crown portion 3 defining an upper face of the clubhead meeting an upper edge of the clubface (F); a sole portion 4 defining the bottom face of the clubhead or sole meeting a lower edge of the clubface (F); a side portion 5 between the crown portion 3 and sole portion 4, which extends from a toe-side edge (t) of the clubface (F) to a heel-side edge (h) of the clubface (F) through a back (B) of the clubhead; and a protruding hosel portion 6 formed near a heel-side position at which the face portion 2, crown portion 3 and side portion 4 meet.

The clubhead 1 has a two-piece structure comprising two pieces or parts welded together.

Figure 3:
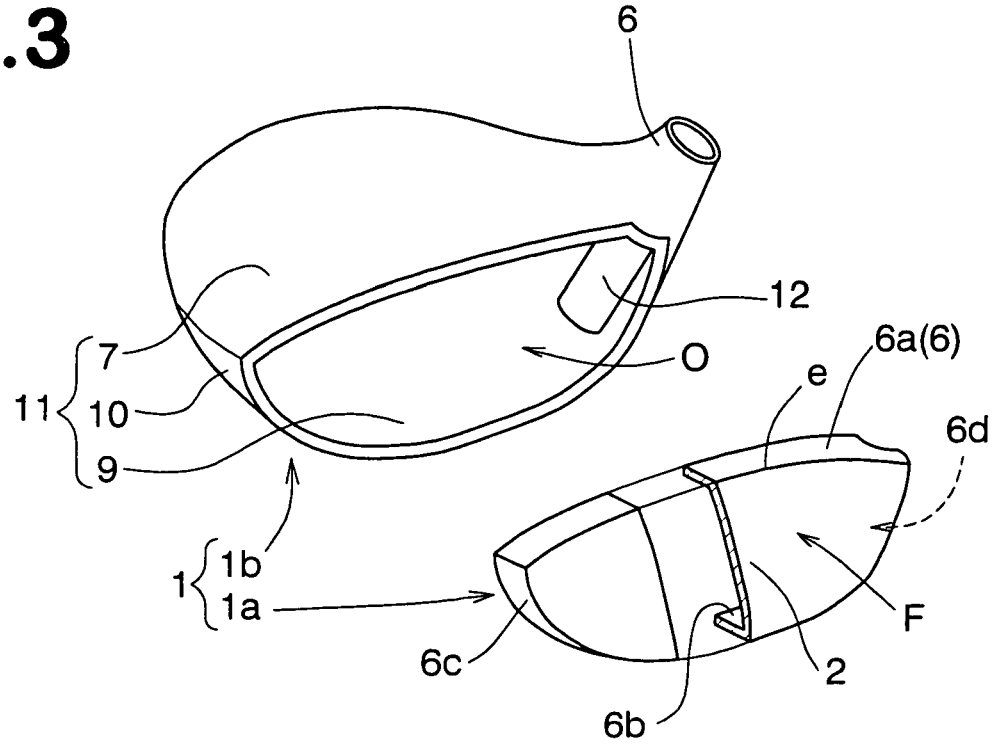
FIG. 3 is an exploded perspective view thereof showing a main body and a face member constituting the clubhead.
Figure 2:
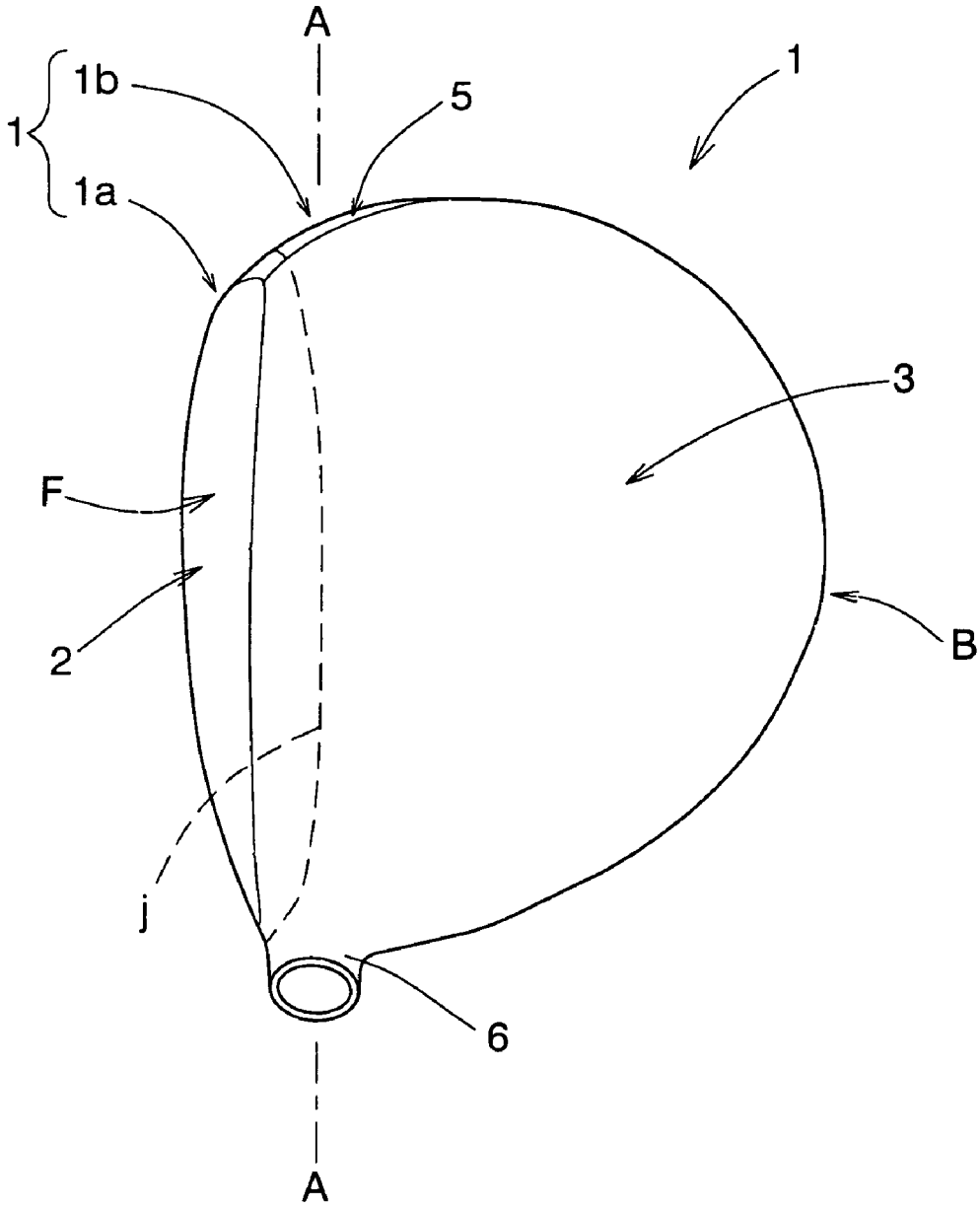
FIG. 2 is a top view thereof.

In this example, as shown in FIG. 3, the clubhead 1 comprises a main body 1*b* and a face member 1*a,* wherein the face member 1*a* is fixed on the front of the main body 1*b* so as to form the face portion 2.

The face member 1*a* in this example comprises a flat main part forming the face portion 2 and a rim 6 extending backward from the edge of the face portion 2. The rim 6 in this example is provided along the entire length of the edge of the face portion 2 so as to form a crown-side rim portion 6*a* forming a part of the crown portion 3, a sole-side rim portion 6*b* forming a part of the sole portion 4, a toe-side rim portion 6*c* forming a toe-side part of the side portion 5, and a heel-side rim portion 6*d* forming a heel-side part of the side portion 5. However, it may be possible to form the rim 6 including at least one of the above-mentioned rim portions 6*a,* 6*b,* 6*c* and 6*d.*

Because the rim 6 provides a distance between the welded part (j) of the face member 1*a* and the main body 1*b* from the edge of the clubface F, the impulsive force transmitted to the welded part (j) at the time of striking a golf ball is dispersed and mitigated. As a result, the durability of the clubhead can be improved. Further, the working property and accuracy may be improved in comparison with the case where the welded part is formed at the edge of the clubface F.

If the width of the rim 6 or the measurement in the back and forth direction is less than 5 mm, it is difficult to obtain such advantageous effects. If the width of the rim 6 is more than 35 mm, it becomes difficult to make the face member 1*a* through plastic forming such as press forming and the like. Therefore, the width is preferably set in a range of from 5 to 35 mm.

For the face member 1*a,* various metallic materials such as aluminum alloy, titanium alloy, stainless and the like may be used. But, in order to make the face member 1*a* through plastic forming, materials suitable therefor are used.

A beta-type titanium alloy is preferably used because it becomes possible to employ cold forging and cold press forming, and thereby it becomes possible to improve the strength without increasing the production cost.

As the beta-type titanium alloy, for example, Ti-15V-3Cr-3Al-3Sn, Ti-22V-4Al, Ti-15Mo-5Zr-3Al, Ti-10V-2Fe-3Al, Ti-13V-11Cr-3Al, Ti-8Mo-8V-2Fe-3Al, Ti-3Al-8V-6Cu-4Mo-4Zr, Ti-11.5Mo-6Zr-4.5Sn, Ti-15Mo-5Zr and the like can be used.

On the other hand, the main body 1*b* is formed into a single piece by casting.

For the main body 1*b,* metallic materials suitable for casting such as aluminum alloy, titanium alloy, stainless and the like are used. In this example, a titanium alloy Ti-6Al-4V is used.

The main body 1*b* comprises a main shell portion 11 having a hollow (i) therein having an opening (O) on the front thereof, and a tubular portion 12 for forming an inner extension of the hosel portion 6.

The main shell portion 11 comprises a crown wall 7, a sole wall 9, and a side wall 10 between the crown wall 7 and sole wall 9, extending from the heel-side to the toe-side. The crown wall 7 is welded to the crown-side rim portion 6*a* and they form the crown portion 3. The sole wall 9 is welded to the sole-side rim portion 6*b* and they form the sole portion 4. The side wall 10 is welded to the toe-side rim portion 6*c* and heel-side rim portion 6*d* and they form the side portion 5.

By welding the rim 6 to the edge of the opening O as above, the face member 1*a* is fixed to the main body 1*b* and the opening O is closed and the closed hollow (i) is formed.

The tubular portion 12 protrudes into the hollow (i) from the inner surface of the main shell portion 11 in the hosel portion 6, while forming a part separating from the inner surface 11*a* of the main shell portion 11 and having a certain length L1. The tubular portion 12 in this example is a circular cylinder having a substantially constant outside diameter and a substantially constant wall thickness. Specifically, the tubular portion 12 is united with the inside of the hosel portion 6, and a gap 14 is formed between the separating part and the inner surface 11*a.*

Figure 4:
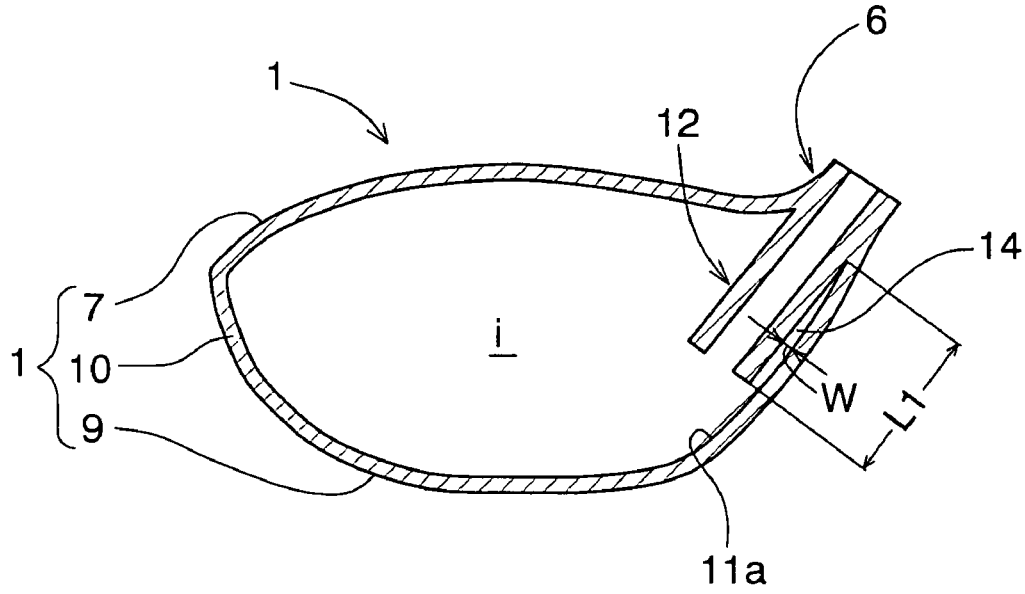
FIG. 4 is a cross sectional view taken along the line A—A in FIG. 2 showing an example of the hosel portion.

In FIG. 4 showing an example of the tubular portion 12, the part separating from the inner surface 11*a* is formed from the tip of the tubular portion 12 to a position immediately inside the hosel portion 6.

Figure 5:
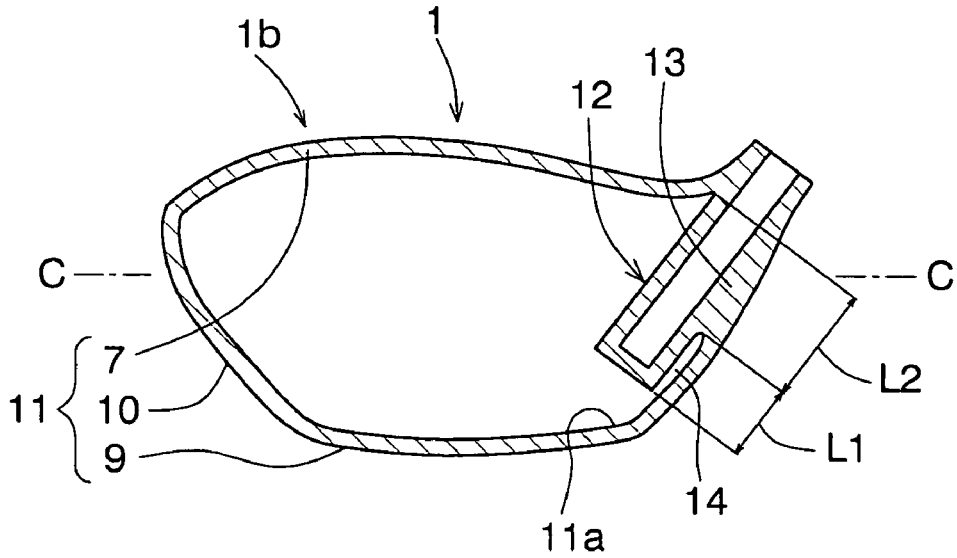
FIG. 5 is a cross sectional view similar to FIG. 4 showing another example of the hosel portion.
Figure 6:
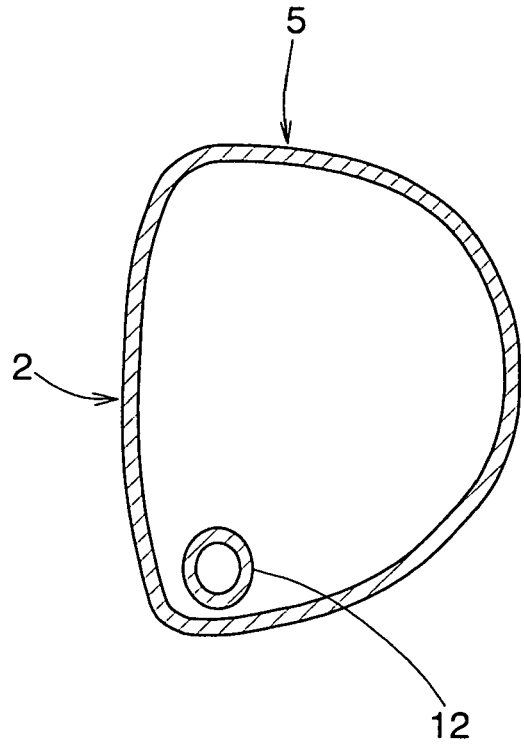
FIG. 6 is a cross sectional view of the clubhead taken along a horizontal plane including a separating part of the inner extension of the hosel.
Figure 7:
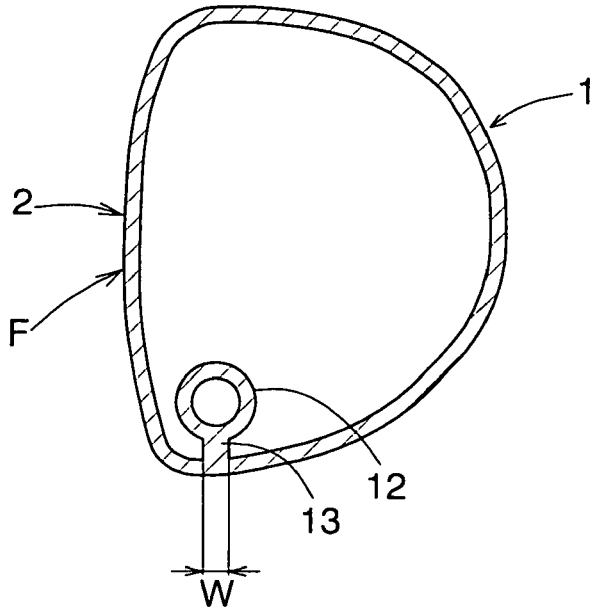
FIG. 7 is a cross sectional view of the clubhead taken along a horizontal plane including a bridged part of the inner extension of the hosel.

In FIG. 5 showing another example of the tubular portion 12, the part separating from the inner surface 11*a* is formed from the tip of the tubular portion 12 to a position at a distance L2 from the hosel portion 6, and from this position to the hosel portion 6 a bridge 13 is formed between the tubular portion 12 and the inner surface 11*a* to improve the durability of the clubhead.

The bridge 13 has a thickness w less than the outside diameter of the tubular portion 12 which is usually set in a range of from 1 to 5 mm, preferably 1.5 to 4.0 mm, more preferably 2.5 to 3.0 mm. The total length L2 of the bridge 13 may be set in a range of from 5 to 30 mm, however, from a point of view of weight saving and durability improvement, it is preferably set in a range of from 7 to 20 mm, more preferably 10 to 15 mm in the axial direction of the shaft.

On the other hand, the length L1 of the separating part may be set in a range of from 5 to 40 mm, however, from a point of view of weight saving, it is preferably set in a range of from 20 to 38 mm, more preferably 30 to 35 mm in the axial direction of the club shaft.

In FIGS. 4 and 5, the tubular portion 12 terminates above the bottom of the hollow (i) and has an open end (FIG. 4) or a closed end (FIG. 5). However, the tubular portion 12 may be extended to the bottom.

In FIGS. 4 and 5, the separating part starts from the tip of the tubular portion 12, but it may be possible to start from a position slightly above the tip as a result of that the tip is joined to the inner surface 11*a* by a bridge 13.

The main body 1*b,* namely, the main shell portion 11, tubular portion 12 and the bridge 13 (if any) are integrally molded. In this embodiment, the main body 1*b* is formed by lost-wax precision casting using a ceramic casting mold.

In order to make the main body 1*b* by lost-wax casting, firstly a lost form M or duplication of the main body 1*b* is made. Secondly, using this lost form M, a casting mold is made. Then, using the casting mold, the main body 1*b* is made.

Here, the lost form is usually regarded as wax model formed by injecting wax into a mold.

Figure 8:
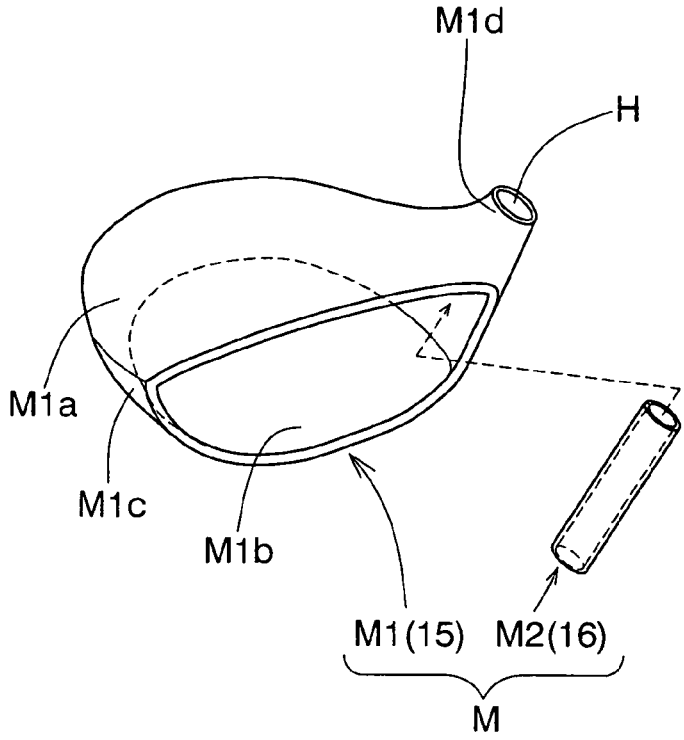
FIG. 8 is an exploded perspective view of a lost form of the main body comprising a main shell part and a tubular part.

FIG. 8 shows an example of the lost form M. The lost form M is composed of two pieces M1 and M2. In this example, the piece M1 corresponds to the main shell portion 11 (hereinafter, the main-shell-portion form 15), and the piece M2 corresponds to the tubular portion 12 (hereinafter, the tubular-portion form).

The main-shell-portion form 15 comprises a crown wall M1*a,* a sole wall M1*b,* a side wall M1*c* between the crown wall M1*a* and sole wall M1*b,* extending from the heel-side to the toe-side, and a hosel portion M1*d* having a hole H.

Figure 9:
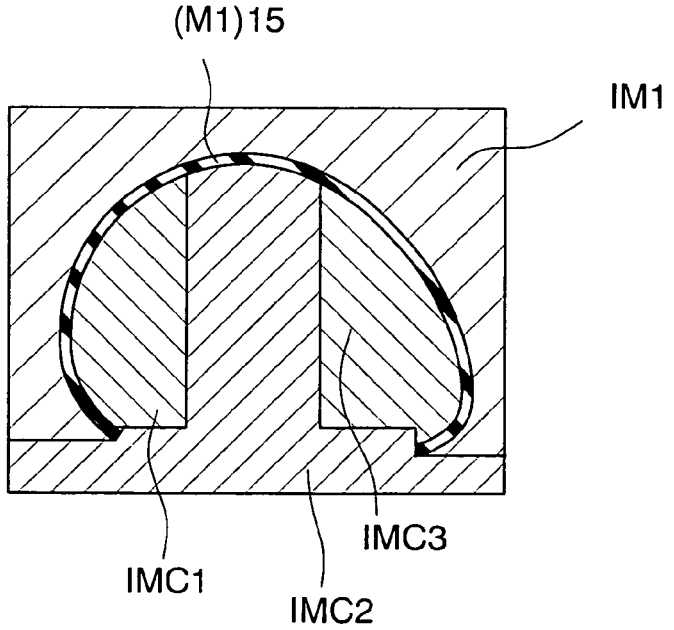
FIG. 9 is a sectional view of the main shell part of the lost form in an injection mold.
Figure 10A:
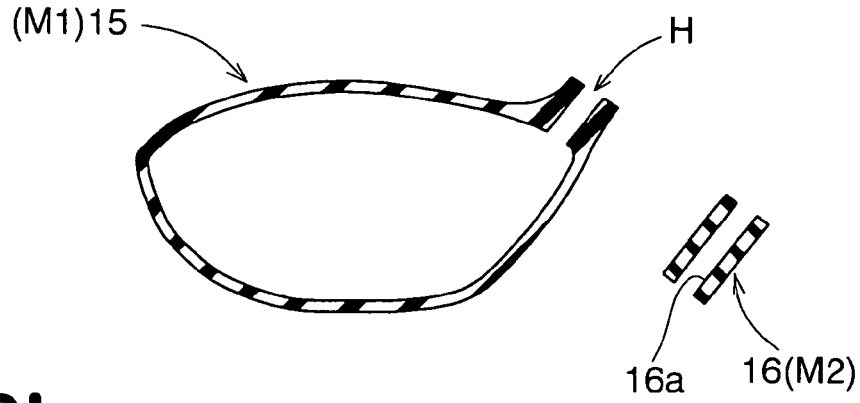
FIGS. 10*a*, 10*b* and 10*c* are schematic cross sectional views for explaining a process of making the lost form.

As shown in FIG. 10*a,* the main-shell-portion form 15 is not provided with an inwardly protruding part corresponding to the tubular portion; therefore, it may be readily formed by injection molding using a first mold (IM) including cores (IMC1, IMC2, IMC3 - - - ) as shown in FIG. 9. The tubular-portion form 16 has a simple cylindrical shape having a through hole 16*a;* therefore, it may be also formed readily by injection molding using a second mold (not shown).

Figure 10B:
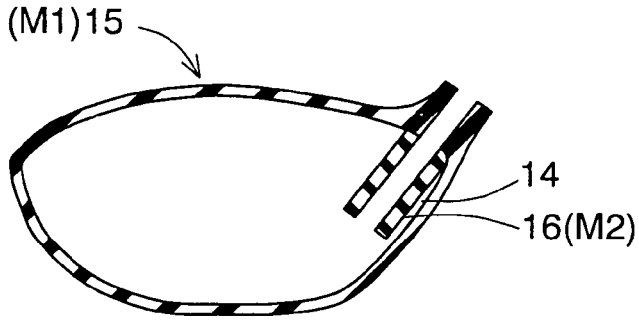
Figure 10C:
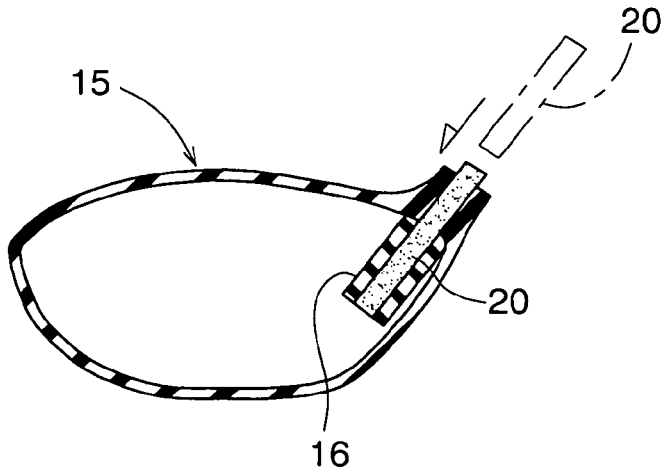

As shown in FIG. 10*b,* the upper end of the tubular-portion form 16 is fixed to the inner surface of the main-shell-portion form 15. In order to fix the main-shell-portion form 15 and tubular-portion form 16, for example, bonding using an adhesive agent or fusion bonding using a soldering iron or the like may be employed. In order to prevent the tubular-portion form 16 from being displaced, a round bar 20 of the same material as the casting mold is inserted in the holes H and 16*a* as shown in FIG. 10*c.*

Figure 11:
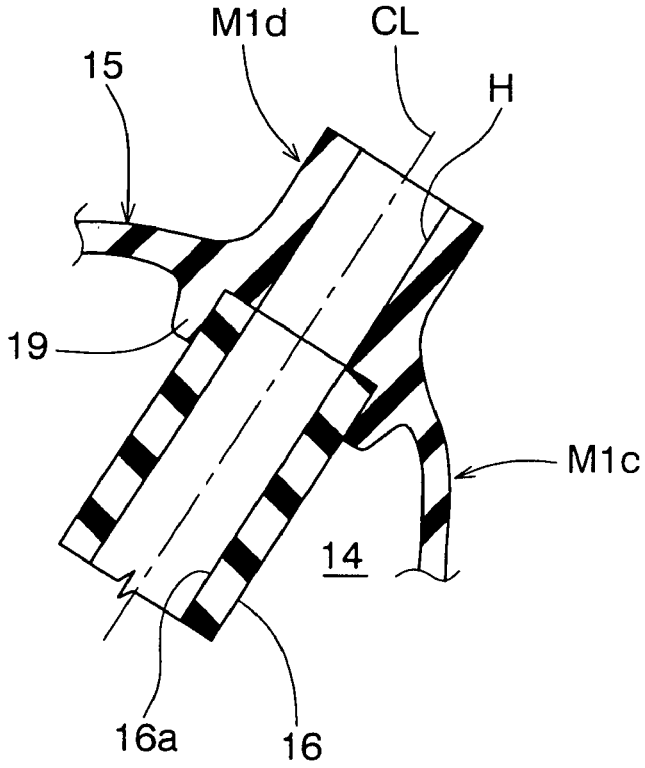
FIG. 11 is an enlarged cross sectional view showing a modification of the hosel portion.

Further, as shown in FIG. 11, in order to secure the upper end of the tubular-portion form 16 and to facilitate aligning the center of the hole H of the hosel portion M1*d* with the center of the hole 16*a* of the tubular-portion form 16, a socket 19 or the like may be provided.

Figure 12:
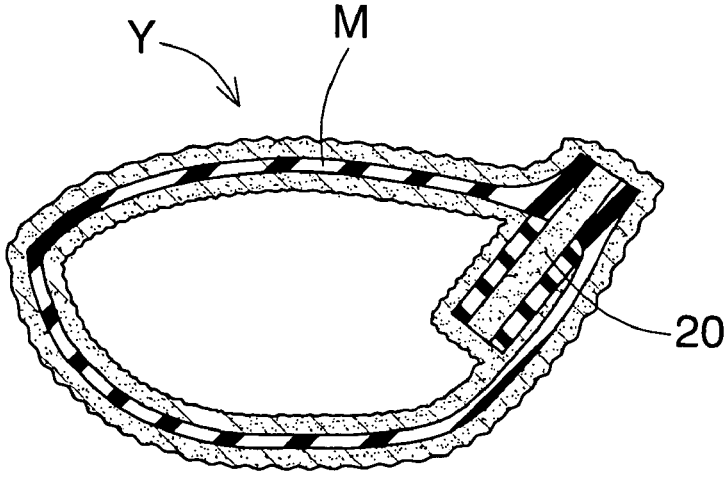
FIG. 12 is a cross sectional view for explaining a process of making a casting mold.

Next, using the lost form M, a casting mold Y is made. As shown in FIG. 12, a fire-resistant material for the casting mold, namely, slurry is applied to the surface of the lost form M, and further fine grains of sand (stucco cement) is applied thereto. After the slurry is hardened, the lost form M is melted by heat to flow out. (dewaxing) Thus, the empty casting mold Y which is a ceramic mold in this example is made.

Then, molten metal is poured into the casting mold Y, using a sprue (not shown). After the metal is hardened, the casting mold is broken up by using shot blast, or hitting with a hammer to take out the main body 1*b,*

Comparison Tests

Wood type golf clubheads were made by way of test. The clubheads had a two-piece structure as shown in FIG. 3. The face member was formed by press forming a beta-type titanium alloy Ti-15V-3Cr-3Al-3Sn. The main body was formed by casting a titanium alloy Ti-6Al-4V. The main body and face member were united with each other by welding.

In Ex.1 and Ex.2, in order to make the lost form of the main body, the main-shell-portion form and the tubular-portion form made separately by injection molding were assembled and fixed by fusion bonding using a soldering iron.

Figure 13A:
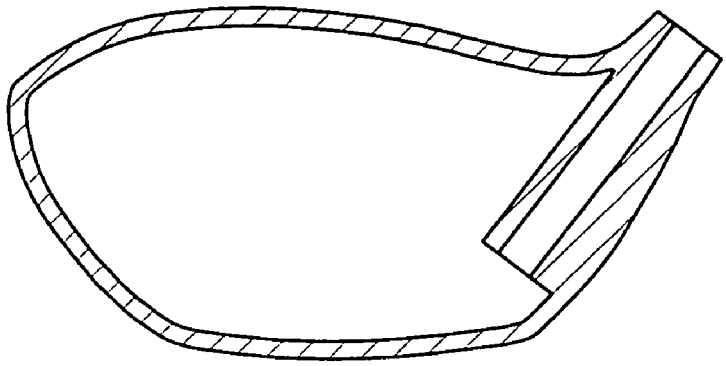
FIGS. 13*a* and 13*b* are schematic cross sectional views of a golf clubhead used in the undermentioned comparison tests taken along a vertical plane and a horizontal plane, respectively.
Figure 13B:
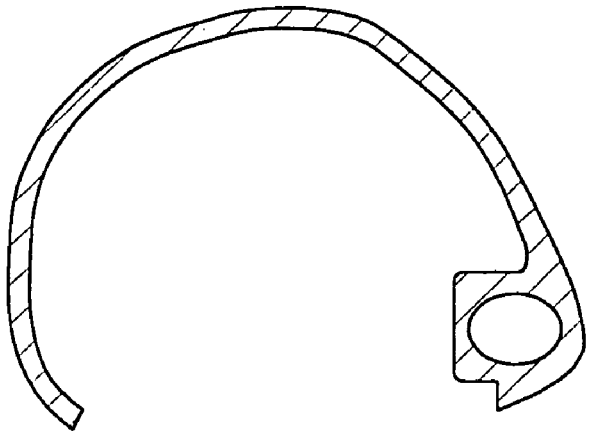

In Ref.1 and Ref.2, the lost form of the main body was integrally molded as shown in FIGS. 13*a* and 13*b.*

Using the lost form, a ceramic casting mold was made, and using the ceramic casting mold the main body was made.

As the targeted values, the clubhead weight was 185 grams. The clubhead volume was 360 cc. The distance of the center of gravity of the clubhead from the axis of the shaft was 35 mm when viewed from the front of the clubface. The depth of the center of gravity of the clubhead from the leading edge was 35 mm when viewed from above the crown portion. The height of the sweet spot was 28 mm—the sweet spot is defined as a point of intersection of the clubface and a normal thereto drawn from the center of gravity of the clubhead.

In adjusting the above parameters to the targeted values, the highest priority was given to the position of the center of gravity in case of Ref.1. In case of Ref.2, the highest priority was given to the head volume.

Flexibility in designing: As the differences of the measurements from the respective targeted values are smaller, the structure can be regarded as being greater in the flexibility in designing.

Durability: The clubhead was attached to a shaft to make a golf club, and the golf club was mounted on a swing robot. The clubhead struck golf balls 3000 times at the head speed of 50 meter/second, and thereafter the clubface was checked for deformation and/or damage.

Variations of clubhead angles: With respect to each of the loft angle, lie angle and hook angle, the mean value for ten samples and their variation were obtained.

The test results are shown in Table 1.

TABLE 1

| | | Targeted | Clubhead | | | |
|---|---|---|---|---|---|---|
| | | | Ex. 1 | Ex. 2 | Ref. 1 | Ref. 2 |
| | | | Structure | | | |
| | | values | FIG. 4 | FIG. 5 | FIG. 13 | FIG. 13 |
| Weight | (g) | 185.0 | 185.0 | 185.0 | 186.0 | 186.5 |
| Volume | (cc) | 360 | 360 | 360 | 351 | 360 |
| Distance of Center of gravity | (mm) | 35 | 35.0 | 34.7 | 35.0 | 32.8 |
| Depth of Center of gravity | (mm) | 35 | 35.0 | 34.8 | 35.0 | 33.9 |
| Height of Sweet spot | (mm) | 28 | 28.0 | 28.0 | 28.0 | 28.2 |
| Average thickness | | | | | | |
| Face portion | (mm) | — | 2.70 | 2.68 | 2.70 | 2.62 |
| Crown portion | (mm) | — | 0.90 | 0.90 | 0.90 | 0.88 |
| Side portion | (mm) | — | 0.90 | 0.90 | 0.90 | 0.86 |
| Sole portion | (mm) | — | 1.10 | 1.10 | 1.10 | 1.08 |
| Bridge | | | | | | |
| Weight | (g) | — | 0 | 1.6 | 5.1 | 5.1 |
| Width | (mm) | — | | 3 | | |
| Length | (mm) | — | | 25 | | |
| Loft angle | (deg.) | 9.0 | 9.0 ± 0.2 | 9.1 ± 0.2 | 9.3 ± 0.8 | 9.3 ± 0.7 |

TABLE 1-continued

| | | Targeted values | Clubhead Structure Ex. 1 FIG. 4 | Ex. 2 FIG. 5 | Ref. 1 FIG. 13 | Ref. 2 FIG. 13 |
|---|---|---|---|---|---|---|
| Lie angle | (deg.) | 56.0 | 56.0 ± 0.2 | 55.9 ± 0.1 | 56.2 ± 0.5 | 56.4 ± 0.6 |
| Hook angle | (deg.) | 1.0 | 1.0 ± 0.2 | 1.1 ± 0.2 | 1.5 ± 1.4 | 1.4 ± 1.2 |
| Durability | | | | | | |
| Dent | (mm) | | 0.05 | 0.08 | 0.05 | 0.13 |
| Damage | | | none | none | none | none |

As to Ex.1, the clubhead whose measurements were just the targeted values could be manufactured as the separating part was relatively long. With respect to the durability, a satisfactory result could be obtained.

As to Ex.2, although the depth and distance of the center of gravity became smaller than the targeted values as the separating part was shorter than Ex.1, the clubhead could be developed to a practical level. As a result of the highest priority given to the head volume, the thickness of the face portion was decreased and the dent was slightly increased when compared with Ex.1, but it was still a practical level.

In Ex.1 and Ex.2, it was confirmed that the variations of the measurements could be well controlled.

As to Ref.1, as a considerable weight was distributed to between the tubular portion 12 and main shell portion 11 and the overall clubhead weight was a given value and further the highest priority was given to the position of the center of gravity, the head volume was obliged to decrease. Thus, the head volume is sacrificed in this case. Under ordinary circumstances, when the weight increases on the heel-side and the clubhead size becomes small, the distance of the center of gravity becomes shorter. In this case, in order to avoid this, by increasing the thickness of each portion on the toe-side, the position of the center of gravity was adjusted.

As to Ref.2, as a considerable weight was distributed to between the tubular portion 12 and main shell portion 11 and the overall clubhead weight was a given value and further the highest priority was given to the head volume, the depth and distance of the center of gravity were obliged to decrease, and further, the thickness of each portion was decreased and the durability test results became worse. Thus, the position of the center of gravity and durability are sacrificed in this case.

In Ref.1 and Ref.2, the variations of the measurements became increased.

What is claimed is:

1. A golf clubhead comprising a main body, and a face member fixed on the front of the main body to form a clubface, the main body formed by casting a metallic material as an integral composite molding, including a main shell portion having a hollow, an upwardly protruding hosel portion through which a shaft inserting hole is provided, a tubular inner extension of the hosel portion through which the shaft inserting hole extends, the tubular inner extension having an outside diameter and protruding into the hollow from the inner surface of the main shell portion, and a single bridge having a thickness less than said outside diameter and formed between the tubular inner extension and the inner surface of the main shell portion, the bridge having a length in a range of from 5 to 30 mm so that a part of the tubular inner extension is separated from the inner surface of the main shell portion, and a length of said part of the tubular extension separated from the inner surface is in a range of from 5 to 40 mm.

2. The golf clubhead according to claim 1, wherein the total length of the separating part is in a range of from 20 to 38 mm.

3. The golf clubhead according to claim 1, wherein the total length of the separating part is in a range of from 30 to 35 mm.

4. The golf clubhead according to clam 1, wherein the length of the bridge is in a range of from 7 to 20 mm.

5. The golf clubhead according to clam 1, wherein the length of the bridge is in a range of from 10 to 15mm.

6. The golf clubhead according to claim 1, wherein the thickness of the bridge is in a range of from 1 to 5 mm.

7. The golf clubhead according to claim 1, wherein the thickness of the bridge is in a range of from 1.5 to 4.0 mm.

8. The golf clubhead according to claim 1, wherein the thickness of the bridge is in a range of from 2.5 to 3.0 mm.

* * * * *